US008283548B2

(12) United States Patent
Oertl et al.

(10) Patent No.: US 8,283,548 B2
(45) Date of Patent: Oct. 9, 2012

(54) METHOD FOR RECOGNIZING NOTE PATTERNS IN PIECES OF MUSIC

(75) Inventors: Stefan M. Oertl, New York, NY (US); Brigitte Rafael, Vienna (AT)

(73) Assignee: Stefan M. Oertl, New York, NY (US)

( * ) Notice: Subject to any disclaimer, the term of this patent is extended or adjusted under 35 U.S.C. 154(b) by 0 days.

(21) Appl. No.: 13/125,200

(22) PCT Filed: Oct. 15, 2009

(86) PCT No.: PCT/AT2009/000401

§ 371 (c)(1),
(2), (4) Date: Jul. 8, 2011

(87) PCT Pub. No.: WO2010/045665

PCT Pub. Date: Apr. 29, 2010

(65) Prior Publication Data

US 2011/0259179 A1 Oct. 27, 2011

(30) Foreign Application Priority Data

Oct. 22, 2008 (EP) ..... 08450164

(51) Int. Cl.
*A63H 5/00* (2006.01)
*G10H 1/22* (2006.01)
*G10H 7/00* (2006.01)

(52) U.S. Cl. ..... 84/609; 84/645; 84/618

(58) Field of Classification Search ..... 84/645, 84/609, 649, 618, 656, 684, DIG. 2; 700/94
See application file for complete search history.

(56) References Cited

U.S. PATENT DOCUMENTS

| | | | | |
|---|---|---|---|---|
| 5,869,782 | A * | 2/1999 | Shishido et al. | 84/609 |
| 6,225,546 | B1 | 5/2001 | Kraft et al. | |
| 6,570,080 | B1 | 5/2003 | Hasegawa et al. | |
| 6,747,201 | B2 * | 6/2004 | Birmingham et al. | 84/609 |

(Continued)

FOREIGN PATENT DOCUMENTS

| | | |
|---|---|---|
| DE | 102004047068 | 4/2006 |

(Continued)

OTHER PUBLICATIONS

International Preliminary Report on Patentability issued Apr. 26, 2011 from related International Application No. PCT/AT2009/000401.

(Continued)

*Primary Examiner* — Elvin G Enad
*Assistant Examiner* — Andrew R Millikin
(74) *Attorney, Agent, or Firm* — Hoffmann & Baron, LLP

(57) ABSTRACT

Method for recognizing similarly recurring patterns of notes in a piece of music containing note sequences distributed among parallel channels, the method having the steps of: a) repeatedly segmenting each channel and, for each type of segmentation, determining segments which are similar to one another and storing the latter in lists of candidate patterns with the respective entities thereof; b) calculating an intrinsic similarity value for each list; c) calculating coincidence values for each list for each channel with respect to the lists for all other channels; and d) combining the intrinsic similarity and coincidence values for each list to form a total value for each list, and using the pattern candidates in the lists with the highest total value in each channel as recognized note patterns in the channel.

15 Claims, 13 Drawing Sheets

U.S. PATENT DOCUMENTS

| | | | | |
|---|---|---|---|---|
| 7,295,985 | B2 * | 11/2007 | Kawashima et al. | 704/500 |
| 2003/0089216 | A1 * | 5/2003 | Birmingham et al. | 84/609 |
| 2003/0182133 | A1 * | 9/2003 | Kawashima et al. | 704/500 |

FOREIGN PATENT DOCUMENTS

| | | |
|---|---|---|
| GB | 2354095 | 3/2001 |

OTHER PUBLICATIONS

International Search Report for PCT/AT2009/000401 dated Jan. 7, 2010.

Jia-Lien Hsu, Chih-Chin Liu, Member, IEEE, and Arbee L P. Chen, Member IEEE, "Discovering Nontrivial Repeating Patterns in Music Data", IEEE Transactions on Kultimedia, vol. 3, No. 3 Sep. 2001, pp. 311-325.

Jose R. Zapata G. and Ricardo A. Garcia, "Efficient Detection of Exact Redundancies in Audio Signals", Audio Engineering Society, Convention Paper 7504, presented at the 125th Convention, Oct. 2-5, 2008 San Francisco, CA XP-002517579.

* cited by examiner

| | | | | | | | | |
|---|---|---|---|---|---|---|---|---|
| $q_1$ | E-E-E- | - | E-E-D- | - | F#-F#-F#- | - | E-E-E- | - |
| $q_2$ | - | - | F G G E | - | - EA | A E - | - | - |
| $q_3$ | E-E-G | E-E-G | E-E-G | E-E-G | E-E-G | E-E-G | E-E-G | E-E-G |

| Pos. | | 1. | 2. | 3. | 4. | 5. | 6. | 7. | 8. | 9. | 10. | 11. | 12. | 13. | 14. | 15. |
|---|---|---|---|---|---|---|---|---|---|---|---|---|---|---|---|---|
| | Note | **A** | **C** | **F** | **C** | **B** | **A** | **C** | **F** | **F** | **C** | **B** | **F** | **F** | **A** | **C** |
| 1. | **A** | - | | | | | 1 | | | | | | | | 1 | |
| 2. | **C** | | - | | 1 | | | 2 | | | 1 | | | | | 2 |
| 3. | **F** | | | - | | | | | 3 | 1 | | | 1 | 1 | | |
| 4. | **C** | | | | - | | | 1 | | | 2 | | | | | 1 |
| 5. | **B** | | | | | - | | | | | | 3 | | | | |
| 6. | **A** | | | | | | - | | | | | | | | 1 | |
| 7. | **C** | | | | | | | - | | | 1 | | | | | 2 |
| 8. | **F** | | | | | | | | - | 1 | | | 1 | 1 | | |
| 9. | **F** | | | | | | | | | - | | | 1 | 2 | | |
| 10. | **C** | | | | | | | | | | - | | | | | 1 |
| 11. | **B** | | | | | | | | | | | - | | | | |
| 12. | **F** | | | | | | | | | | | | - | 1 | | |
| 13. | **F** | | | | | | | | | | | | | - | | |
| 14. | **A** | | | | | | | | | | | | | | - | |
| 15. | **C** | | | | | | | | | | | | | | | - |

*Fig. 4*

| Pattern | | Instances | | | | . . | Length | Freq. |
|---|---|---|---|---|---|---|---|---|
| $m_I$ | **A – C** | 1/2 | 6/7 | 14/15 | | | 2 | 3 |
| $m_{II}$ | **C – F** | 2/3 | 7/8 | | | | 2 | 2 |
| $m_{III}$ | **F – C** | 3/4 | 9/10 | | | | 2 | 2 |
| $m_{IV}$ | **C – B** | 4/5 | 10/11 | | | | 2 | 2 |
| $m_V$ | **F – F** | 8/9 | 12/13 | | | | 2 | 2 |
| $m_{VI}$ | **A – C – F** | 1/2/3 | 6/7/8 | | | | 3 | 2 |
| $m_{VII}$ | **F – C – B** | 3/4/5 | 9/10/11 | | | | 3 | 2 |
| : | : | | | | | | | |

*Fig. 5*

| | |
|---|---|
| Until preliminary list is empty: | |
| | (i) Look for "best" pattern in preliminary list |
| | (ii) Store as candidate pattern in list |
| | (iii) Delete "overlap" from preliminary list |

*Fig. 6*

List $L_1$

| Pattern | | Instances | | |
|---|---|---|---|---|
| $m_{1a}$ | A – C | 1/2 | 6/7 | 14/15 |
| $m_{1b}$ | F – C – B | 3/4/5 | 9/10/11 | |

| List $L_2$ | | Instances | | | | |
|---|---|---|---|---|---|---|
| Pattern | | $i_1$ | $i_2$ | $i_3$ | $i_4$ | . . $i_i$ . . |
| $m_{2a}$ | **A – C – F** | 1-3 | 7-9 | 14-16 | | |
| $m_{2b}$ | **C – B – A** | 4-6 | 10-12 | | | |
| : | : | | | | | |

| $m_{nx}$ | $i_1$ | $i_2$ | $i_3$ | $i_4$ | $i_5$ |
|---|---|---|---|---|---|
| $i_1$ | - | 0,5 | 1 | 0,7 | 0,8 |
| $i_2$ | | - | 0,5 | 0,3 | 1 |
| $i_3$ | | | - | 0,7 | 0,8 |
| $i_4$ | | | | - | 0,3 |
| $i_5$ | | | | - | - |

| | | | | | | | | | |
|---|---|---|---|---|---|---|---|---|---|
| ch1 | E - E - E - | | E - E - D - | | F#-F#-F#- | | E - E - E - | | G1 |
| ch2 | | | F G G E | | E A A E | | | | G2 |
| ch3 | E - E - G | E - E - G | E - E - G | E - E - G | E - E - G | E - E - G | E - E - G | E - E - G | G3 |

METHOD FOR RECOGNIZING NOTE PATTERNS IN PIECES OF MUSIC

CROSS-REFERENCE TO RELATED APPLICATIONS

This application is a National Phase application of International Application No. PCT/AT2009/000401 filed Oct. 15, 2009 which claims priority to European Patent Application No. EP 08450164.2 filed Oct. 22, 2008.

BACKGROUND

The present invention relates to a method for recognizing similarly recurring patterns of notes in a piece of music, which contains note sequences distributed on parallel channels.

The recognition of recurring note patterns in pieces of music, e.g. loops, riffs, phrases, motifs, themes, verses, refrains, transitions, movements etc., has become an extensive field of research in recent years with specific and promising technical applications. Some examples of application to be mentioned are the automated analysis of musical structures in pieces of music in computer-aided recording studio, audio workstation and music production environments, which must be based on a reliable music recognition for archiving and sorting purposes as well as the resynthesis of existing note patterns into new compositions. A further specific technical application is the analysis and indexing of large music data banks, e.g. of music archives or online music shops, according to identifiable note patterns for the new field of music information retrieval (MIR), for example, to be able to process "fuzzy" user queries in an automated manner, code word "query by humming"

A wide variety of methods have already been proposed in the past for pattern recognition in single-channel pieces of music that also adopt concepts from other fields of pattern recognition such as "string matching" techniques from the field of DNA sequence analysis, e.g. as in Kilian Jürgen, Hoos Holger H.: "MusicBLAST—Gapped Sequence Alignment for MIR", International Conference on Music Information Retrieval (ISMIR), 2004. String matching methods are frequently based on the use of dynamic programming algorithms for the alignment and the similarity comparison of note sequences, cf. e.g. Hu Ning, Dannenberg Roger B., Lewis Ann L.: "A Probabilistic Model of Melodic Similarity", Proceedings of the ICMS, 2002.

In Hsu Jia-Lien, Liu Chih-Chin, Chen Arbee L. P.: "Discovering Nontrivial Repeating Patterns in Musical Data", IEEE Transactions on Multimedia, vol. 3, no. 3, 2001, the use of a correlation matrix, which allows nontrivial, i.e. not excluding one another, identically recurring patterns in a channel to be detected, is proposed specially for the recognition of identically recurring note patterns for the purposes of music analysis and MIR.

All methods known hitherto have the characteristic that they respectively analyse each channel of a multi-channel piece of music separately. The inventors of the present method have recognized that there is a significant disadvantage in the known methods, because structure information contained specifically in the musical parallelism of the channels, i.e. their rhythmic, melodic and polyphonic context, are completely ignored thereby, and this results in the unsatisfactory rate and quality of recognition of the known methods.

Therefore, there is continuous demand for an improved method of pattern recognition for multi-channel pieces of music. The aim set by the invention is to provide such a method.

SUMMARY OF THE INVENTION

This aim is achieved with a method of the aforementioned type that is distinguished by the following steps: a) repeatedly segmenting each channel by varying segment length and segment beginning and, for each type of segmentation, determining segments that are similar to one another and storing these in lists of candidate patterns with their respective instances, i.e. one list respectively for each type of segmentation and channel; b) calculating an intrinsic similarity value for each list, which is based on the similarities of the instances of each candidate pattern of a list with one another; c) calculating coincidence values for each list for each channel with respect to the lists for all other channels, which is respectively based on the overlaps of instances of a candidate pattern of one list with instances of a candidate pattern of the other list when these overlap at least twice; and d) combining the intrinsic similarity and coincidence values for each list to form a total value for each list and using the pattern candidates in the lists with the highest total value in each channel as recognized note patterns in the channel.

The method of the invention thus takes into consideration for the first time and in a significant manner the parallel structure information of a multi-channel piece of music, which can be concealed in the temporal coincidences of potential patterns (candidate patterns) in different channels, and combines these with an assessment of the soundness of discovered candidate patterns on the basis of the intrinsic similarities of their instances, their so-called "fitness". In consequence, a substantially more reliable, more meaningful and more relevant pattern recognition result is obtained than with all the methods known hitherto.

It should be mentioned at this point that the term "channel" used here for a multi-channel piece of music is to be understood in its most general form, i.e. in the sense of a single voice (monophonic) of a multi-voice (polyphonic) movement, in the sense of a (possibly also polyphonic) instrument voice such as a bass, trumpet, string, percussion, piano part etc., as well as in the sense of a technical channel such as a midi-channel, which can contain both monophonic and polyphonic voices, parts or combinations thereof, e.g. a drum pattern, a chord sequence, a string movement etc.

A particularly advantageous embodiment of the invention is distinguished in that in step a) the following step is additionally conducted:

a1) detecting the patterns identically recurring in a channel, selecting therefrom the patterns best covering the channel and storing these in a further list of candidate patterns with their respective instances for each channel.

The degree of recognition can be still further increased as a result. Channel-related pattern recognition is thus based on two equivalent principles, an identity recognition and a similarity recognition, and different methods can be used for these variants. Incorporating the recognition results of both variants into one and the same list set of candidate patterns results in an implicit combination of the two methods in the subsequent list evaluation by means of the intrinsic similarity and coincidence values, since the results of the two methods are in competition with one another there. The method of the invention is thus self-adaptive for different types of input signals, which respond differently to different types of recognition processes.

In step a1) the detection of identically recurring patterns is preferably conducted by means of the correlation matrix method, as is known per se from Hsu Jia-Lien et al. (as above). It is particularly preferred if in step a1) the selection of the best covering patterns is achieved by iterative selection of the respective most frequent and/or longest pattern from the detected patterns.

According to a further preferred feature of the invention, in step a) the segment length is varied in multiples of the rhythmic unit of the piece of music, which limits the variation possibilities to a suitable degree and saves computing time. It is particularly favourable if the segment length is varied from double the average note duration of the piece of music to half the length of the piece of music.

According to a further advantageous embodiment of the invention, in step a) the determination of segments that are similar to one another is achieved by aligning the notes of two segments with one another, determining a degree of consistency of both segments and recognizing similarity when the degree of consistency exceeds a preset threshold value. These measures can be implemented speedily with a feasible computing effort.

In particular, the alignment of the notes is achieved in this case by means of the dynamic programming method as is known per se from Kilian Jürgen et al. (as above) or Hu Ning et al. (as above with further evidence).

According to a preferred embodiment of the method, the calculation of the intrinsic similarity value in step b) occurs in that for each candidate pattern for the list a similarity matrix of its instances is drawn up, the values of which are combined to form the intrinsic similarity value for the list, preferably with weighting by the channel coverage of the candidate patterns for the list. It has been found that this embodiment leads to a quick and stable implementation.

To further improve the recognition result, at the end of step b) those lists for a channel whose intrinsic similarity value does not reach a preset threshold value can optionally be deleted. This preset threshold value is preferably adaptive, in particular a percentage of the highest intrinsic similarity value of all lists for the channel, particularly preferred at least 70%. In a particularly suitable embodiment in practice the threshold value amounts to about 85%.

A particularly advantageous variant of the method of the invention lies in that in step c) for a specific candidate pattern of a list only the overlaps with those instances of the other list, with which the longest overlaps in time are present, are taken into consideration. It has been found in practical tests that this leads to a satisfactory recognition rate and simplifies the method in this step.

According to a further preferred variant of the invention it is provided that when combining step e) for each list for each channel only those coincidence values to the lists of the other channels that represent the respectively highest value there are taken into consideration, and this improves the recognition rate still further.

For the same reason it is preferably provided that when combining step e) the coincidence values taken into consideration for a list are respectively added up, and it is particularly preferred if the added coincidence values are multiplied by the intrinsic similarity value for the list to form the said total value.

BRIEF DESCRIPTION OF THE DRAWINGS

The invention is explained in more detail below on the basis of preferred exemplary embodiments with reference to the accompanying drawings:

FIG. 4 shows an example of a correlation matrix for step a1) of the method;

FIG. 5 shows the result of the detection phase of step a1);

FIG. 6 is a flow chart for the selection phase for the best covering patterns in step a1);

DETAILED DESCRIPTION

Figures 1, 2:
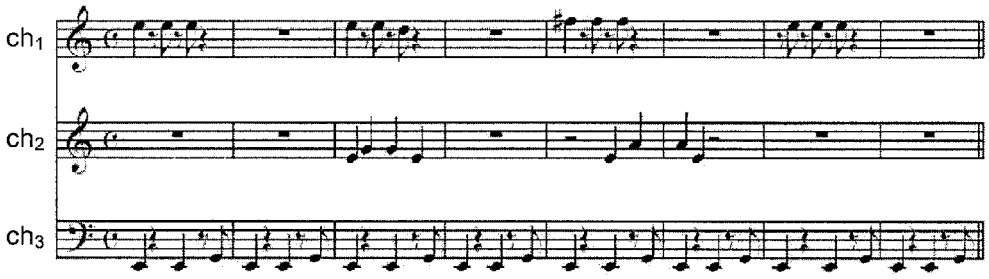
FIGS. 1 and 2 show an exemplary multi-channel piece of music as input signal of the present method in music notation (FIG. 1) and a note sequence diagram (FIG. 2)

FIG. 1 shows a section from a piece of music containing note sequences $q_1$, $q_2$ and $q_3$ (in general $q_p$) distributed on parallel channels $ch_1$, $ch_2$ and $ch_3$ (in general $ch_p$) and shown schematically in FIG. 2. The channels $ch_p$ are, for example, separate MIDI channels for the different instruments or voices of the piece of music, although this is not essential, as explained above.

In the interests of simplicity, only the note pitches and the times of incidence of the individual notes in the note sequences $q_p$ are taken into consideration in the present examples, but not further note parameters such as e.g. note duration, loudness, striking speed, envelope, tone, key context, etc. However, it is understood that all comparisons of individual notes or note patterns described below can also extend equally to such parameters, if desired, i.e. multistage or multi-dimensional identity or similarity comparisons between multiple parameters can also be conducted accordingly in these comparisons.

Moreover, in the interests of simplicity also only monophonic note sequences are considered in each channel in the present examples. However, it is understood that the method proposed here is equally suited to polyphonic note sequences in the channels, for which extended identity or similarity comparisons, e.g. chord comparisons and key context comparisons etc., can be employed accordingly.

As is thus evident for the person skilled in the art, the method proposed here can be easily scaled to multiple note parameter comparisons and polyphonic note sequences.

Figure 3:
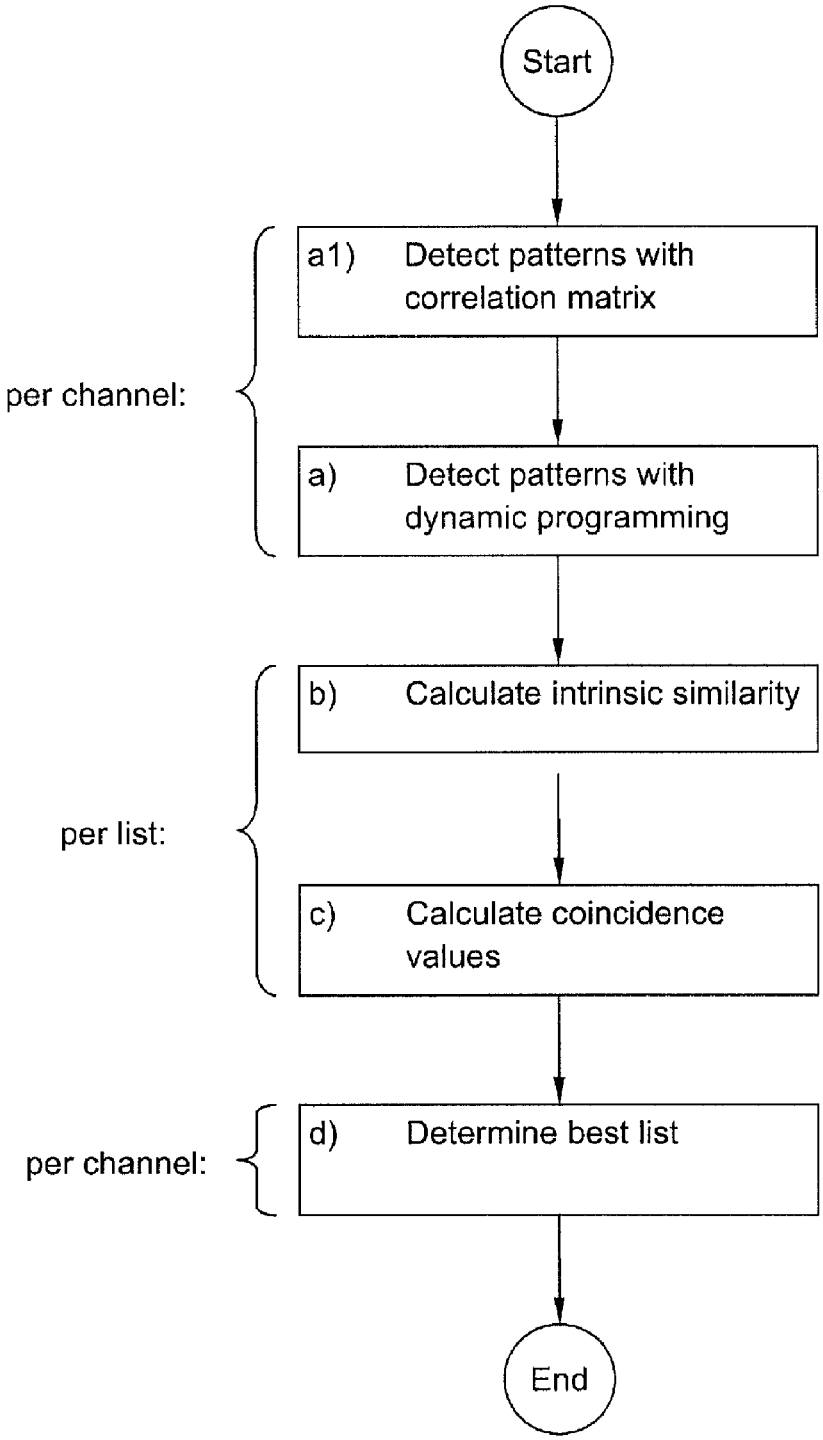
FIG. 3 is a global flow chart of the method according to the invention.

FIG. 3 shows the global sequence of the method on the basis of its five fundamental steps a1), a), b), c) and d), which shall be explained in detail below. These five global steps are: a1) detecting the patterns identically recurring in a channel, selecting therefrom the patterns best covering the channel and storing these in a list of candidate patterns with their respective instances for each channel; a) repeatedly segmenting each channel by varying segment length and beginning, and for each type of segmentation determining segments that are similar to one another and storing these in further lists of candidate patterns with their respective instances, i.e. one list respectively for each type of segmentation and channel; b) calculating an intrinsic similarity value for each list, which is based on the similarities of the instances of each candidate pattern of a list with one another; c) calculating coincidence values for each list for each channel with respect to the lists for all other channels, which is respectively based on the overlaps of instances of a candidate pattern of one list with instances of a candidate pattern of the other list when these overlap at least twice; and d) combining the intrinsic similarity and coincidence values for each list to form a total value for each list and using the pattern candidates in the lists with the highest total value in each channel as recognized note patterns in the channel.

The represented sequence of steps a1)-a)-b)-c)-d) is only essential insofar as some steps assume the result of others. Otherwise, the sequence is arbitrary. For example, the sequence of steps a1) and a) could be interchanged, or the sequence of steps b) and c), and so on.

In a simplified embodiment of the method step a1) can optionally be omitted with the range of application of the method limited accordingly, as explained above.

Steps a1) to d) will now be explained in detail.

a1) Pattern Detection by Means of Correlation Matrix

To detect the identically recurring note patterns (identical "loops") in a channel $ch_p$ a correlation matrix is firstly drawn up for each channel $ch_p$ in accordance with Hsu Jia-Lien et al. (as above) in step a1). FIG. 4 shows an example of such a correlation matrix: the first line and the first column respectively contain the entire note sequence of a channel, in which patterns are to be detected; and only a triangle of the matrix is relevant. The first entry "1" in a line means that a note in the sequence is already appearing for the second time; and entry "2" means that the pattern consisting of this and the previous note with length 2 ("2-loop") is appearing for the second time; the entry "3" that the pattern consisting of this and the previous note with length 3 ("3-loop") is appearing for the second time in this line, etc. Reference is made to Hsu Jia-Lien et al. (as above) for details of the correlation matrix method.

Through statistical evaluation of the entries in the correlation matrix FIG. 4 a preliminary list can be drawn up for each channel in accordance with FIG. 5, in which note patterns $m_I$, $m_{II}$, $m_{III}$, $m_{IV}$ etc. found to be identically recurring are specified with the positions in which they occur or appear in the note sequence $q_p$, i.e. their so-called "instances", as well as their length and frequency.

From the preliminary list of FIG. 5 those note patterns that cover channel $ch_p$ as far as possible and also without overlap are now sought for further processing using the search method outlined in FIG. 6. For this, the preliminary list FIG. 5 is processed in a loop according to FIG. 6 and in each case (i) the "best" pattern $m_I$, $m_{II}$ etc. is looked for, (ii) this is stored as candidate pattern $m_{1a}$, $m_{2a}$ etc. in a first list $L_1$ (FIG. 7) together with its instances, and (iii) all patterns overlapping with this candidate pattern are deleted from the preliminary list FIG. 5.

The "best" pattern in step (i) is respectively the most frequent and/or longest pattern $m_I$, $m_{II}$ etc. in the preliminary list FIG. 5. It is particularly preferred if the following criterion for the "best" pattern is used:

The most frequent pattern is selected unless there is a longer candidate pattern that covers more than 75% of the channel and occurs at last ⅔ as often.

Figures 7, 8:
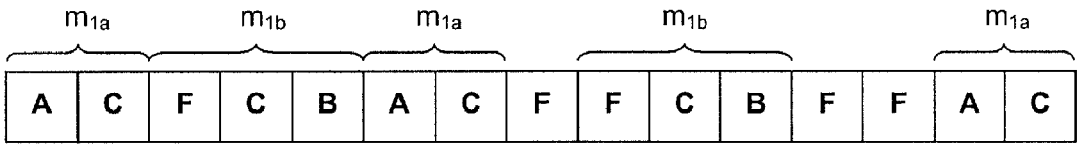
FIG. 7 shows the result of step a1) in the form of a first list of candidate patterns and their instances for a channel.
FIG. 8 shows the significance of the list of FIG. 7 with respect to channel coverage.

Therefore, the result obtained from step a1) for each channel $ch_p$ is a first list $L_1$ of candidate patterns $m_{1a}$, $m_{1b}$ (in general $m_{1x}$), which cover the channel $ch_p$ or its note sequence $q_p$ without overlap and as far as possible, i.e. as gap-free as possible, see FIG. 8.

a) Pattern Detection by Means of Segment Similarity Comparison

Figure 9:
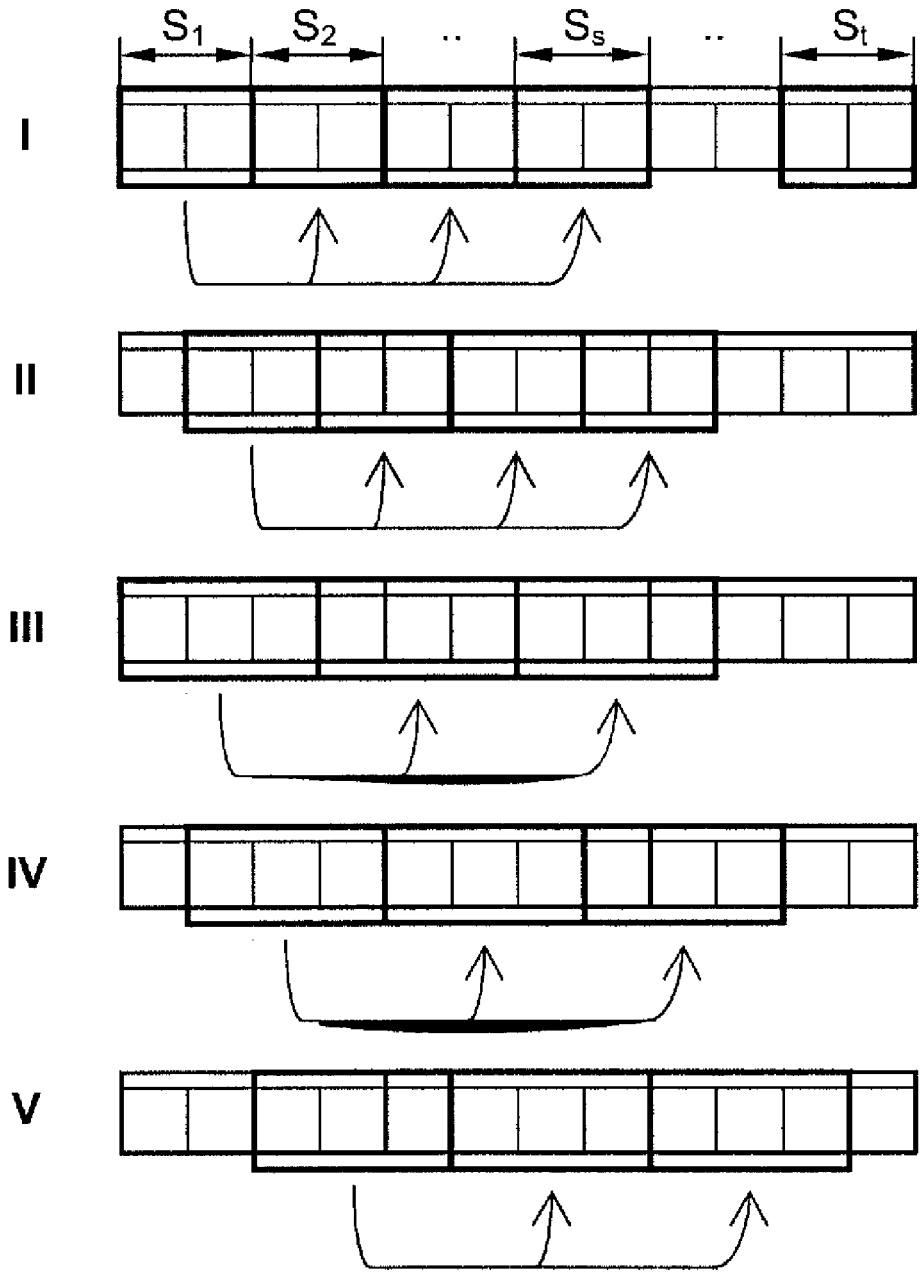
FIG. 9 shows several types of segmentation of a channel for determining the similarity in step a) of the method.

A second approach is followed in step a). Each channel $ch_p$ is segmented repeatedly and respectively in different ways, i.e. by varying segment length and beginning. FIG. 9 shows five exemplary types of segmentation I-V, wherein the segment length is varied in multiples of the rhythmic unit of the piece of music, i.e. the duration of a beat of the piece of music; e.g. in 4/4 time the rhythmic unit is a crotchet (quarter note).

The shown types of segmentation I and II are based on a segmentation into segments with a length of two beats, wherein in segmentation II the segment beginning has been displaced by one beat.

The types of segmentation III—V are based on a segment length of three beats and a successive displacement of the segment beginning by one beat in each case.

It is understood that this concept can be extended accordingly to any desired segmentation lengths, beginnings and also to any desired fine quantisation units (beats) of the note sequences.

In this case, the segment length of double the average note duration of the piece of music is preferably varied to half the length of the entire piece of music at maximum, since the maximum length of a note pattern can be half the length of the piece of music at most. If desired, the process could also be stopped earlier to shorten it, i.e. segment length could be varied only to a given number of pulses, for example.

For each possible type of segmentation I, II, III etc. the similarity of the segments $S_1$, $S_2$, etc. with one another is now determined, i.e. preferably using the dynamic programming method known in the art.

Figure 10:
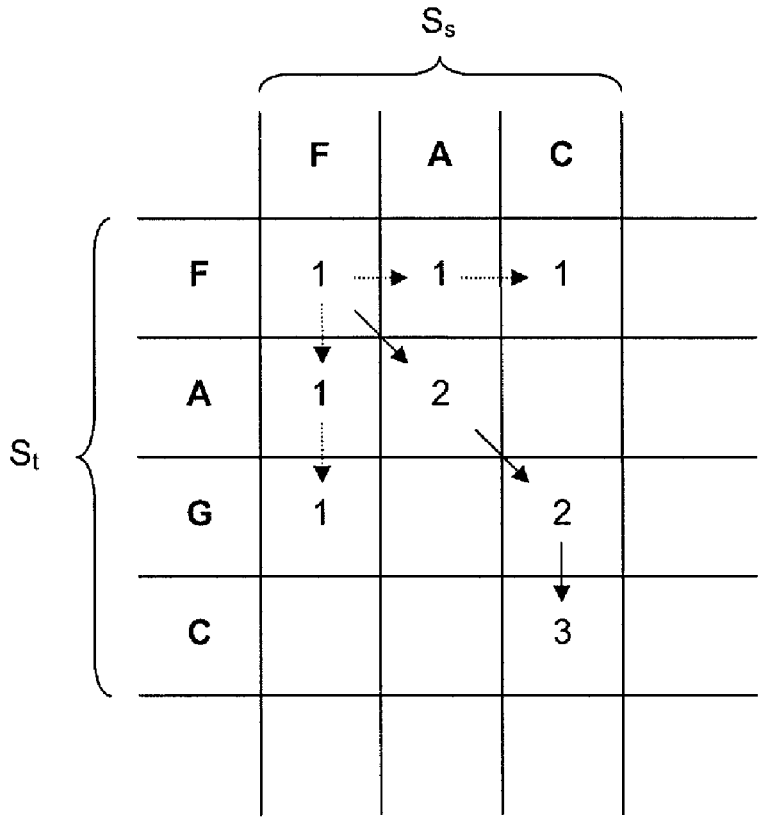
FIG. 10 shows an example of a dynamic programming algorithm for aligning two segments.

To explain this method, reference is now made only briefly to FIG. 10, in which note sequences from two exemplary segments $S_s$ and $S_t$ are compared to one another in a matrix. According to the rules of the dynamic programming algorithm, weightings are now given for the progression from cell to cell, i.e. in the present example the dynamic programming weightings {0, 0, 0, 1} are given as {"penalty for insert", "penalty for delete", "penalty for replace", "points for match"}. Reference is made here to Kilian Jürgen et al. (as above) and Hu Ning et al. (as above) for details of the dynamic programming method, which also contain further literature references thereto.

Figure 11:
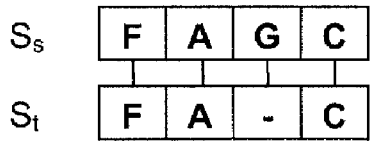
FIG. 11 shows the result of the alignment of FIG. 11 for the comparison of similarity of two segments.

Using the dynamic programming alignment method of FIG. 10 even non-identical i.e. merely similar note sequences and even those of unequal length in the segments are aligned to one another. FIG. 11 shows the alignment result obtained.

The similarity of segments $S_s$ and $S_t$ is then evaluated by means of an accordingly selected point evaluation chart between 0% (dissimilar) and 100% (identical), e.g. on the basis of the number of identical notes, the number of gaps, the pitch interval of deviating notes etc. Two segments $S_s$, $S_t$ are then recognized as "similar" when their similarity value determined in such a manner lies above a preset threshold value, preferably above 50%.

Figures 12, 13:
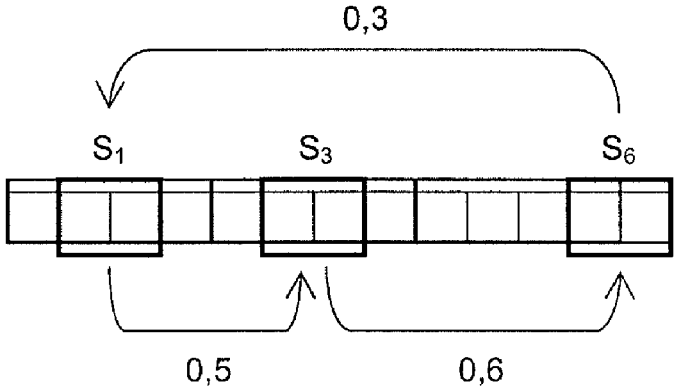
FIG. 12 shows similar and transitively similar segments of a channel, which represent the instances of a recognized candidate pattern.
FIG. 13 shows the result of step a) in the form of a further list of candidate patterns and their instances for a channel and a specific type of segmentation of this channel.

In this way, all segments $S_s$ are now compared with all other segments $S_t$ of a type of segmentation I, II etc. of a channel $ch_p$. For segmentation type II of channel $ch_p$, for example, this leads to recognition of a similarity between the segments $S_1$, $S_3$ and $S_6$, as shown in FIG. 12: segments $S_1$ and $S_3$ here are 50% similar, segments $S_3$ and $S_6$ are 60% similar and segments $S_1$ and $S_6$ are 40% "transitively similar".

All segments that are similar to one another or also only transitively similar are now compiled again as instances $i_i$ of a candidate pattern, which results from the note sequence of one (e.g. the first) of these segments. The candidate patterns found for a segmentation type of a channel in this way are stored in the form of a further list $L_2$ of candidate patterns $m_{2a}$, $m_{2b}$ etc. with their respective instances $i_1$, $i_2$ etc., see FIG. 13.

Figure 14:
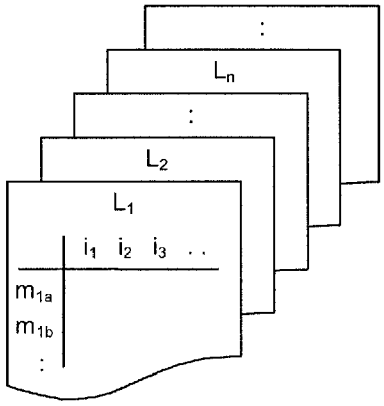
FIG. 14 shows the entire result of step a) represented as a set of multiple lists for a channel.
Figure 15:
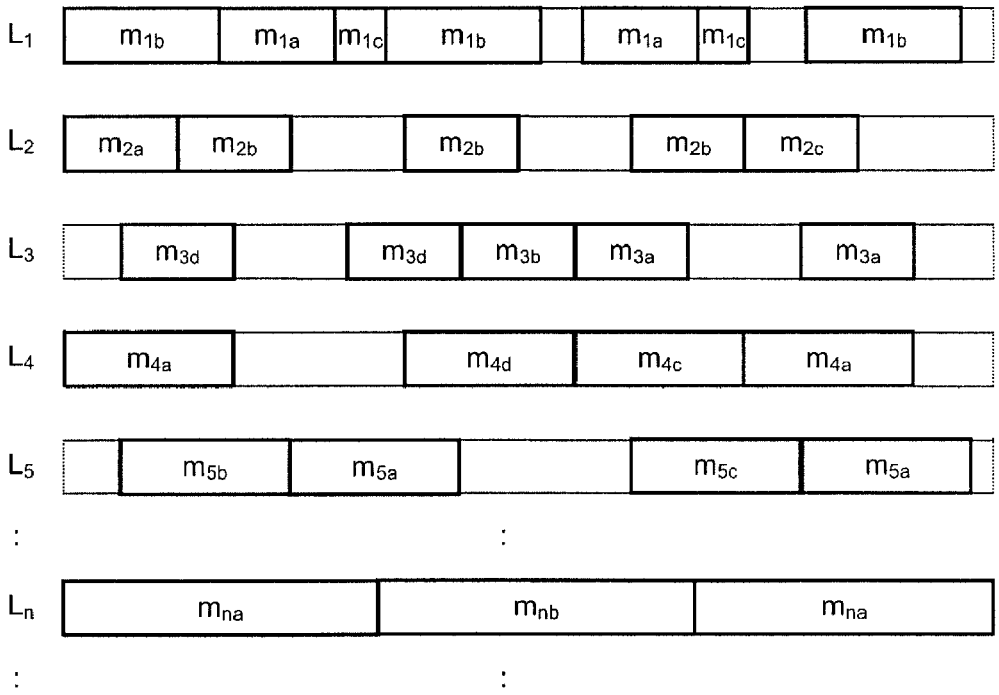
FIG. 15 shows the significance of the lists of FIG. 14 in the form of different possible coverages of a channel with the respective candidate patterns of its lists.

All lists $L_2$, $L_3$ etc. for all possible segmentation types I, II etc. of a channel $ch_p$ together with the previously discussed first list $L_1$ from step a1) provide a set of lists $L_n$ for each channel $ch_p$, see FIG. 14, which represents various possible coverages of the channel $ch_p$ with candidate patterns, see FIG. 15.

The lists $L_n$ are now evaluated in the following steps b), c) and d).

b) Calculation of the Intrinsic Similarity Values

Figures 16, 17:
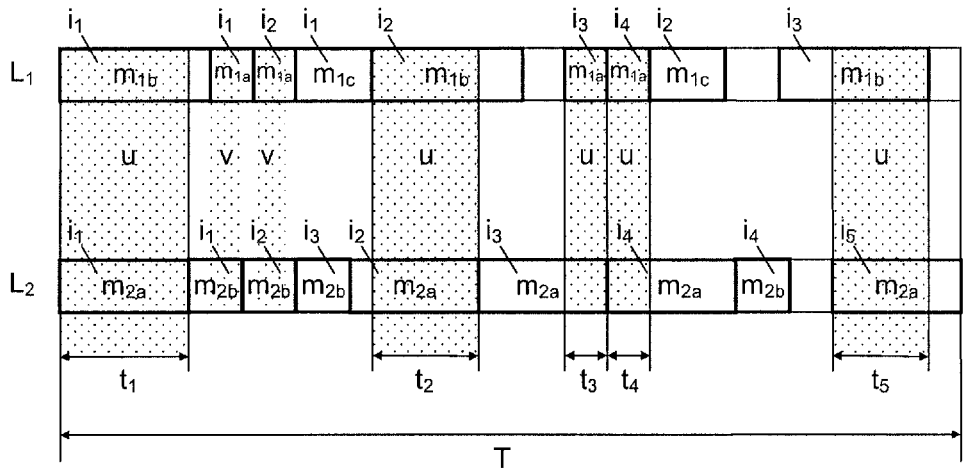
FIG. 16 shows a similarity matrix for the instances of a candidate pattern of a list as basis for the calculation of the intrinsic similarity value of a list according to step b)
FIG. 17 shows an overlap comparison between the pattern instances of two lists as basis for the calculation of the coincidence values of a list according to step c)

In step b) an intrinsic similarity value $E_n$ is firstly calculated for each list $L_1$, on the basis of similarity matrices for all candidate patterns $m_{na}$, $m_{nb}$ etc. (in general $m_{nx}$) for list $L_n$. FIG. 16 shows an exemplary similarity matrix for the instances $i_1$, $i_2$, $i_3$ and $i_4$ of a candidate pattern $m_n$ for list $L_n$: the cells of the matrix reflect the degree of similarity, e.g. as determined in accordance with the dynamic programming step of step a); e.g. the similarity between instance $i_1$ and instance $i_3$ here amounts to 80%.

An intrinsic similarity value $E_{nx}$ for the candidate pattern $m_{nx}$ is now determined from all values of the similarity matrix FIG. 16, e.g. by adding in the form:

$$E_{nx} = \sum_{k,l} \text{similarity between } i_k \text{ and } i_l$$

Alternatively, an evaluation chart can also be used that statistically evaluates or assesses the values in the cells of the similarity matrix, preferably in the following form:

if at least one cell per line has the entry "1", then $E_{nx}$ is incremented by 2, i.e.

$$E_{nx} := E_{nx} + 2;$$

if not then $E_{nx}$ is only incremented by the average value of all cells of this line, i.e.

$$E_{nx} := E_{nx} + \text{line average}.$$

The intrinsic similarity value $E_{nx}$ of the candidate pattern $m_{nx}$ is also called "loop fitness" of the candidate pattern $m_{nx}$.

The intrinsic similarity value $E_n$ of list $L_n$ then results as a sum of the intrinsic similarity values $E_{nx}$ of all candidate patters $m_{nx}$ of list $L_n$ multiplied by the channel coverage P, which all instances of all candidate patterns $m_{nx}$ of list $L_n$ reach, i.e.

$$E_n = \sum_x E_{nx} * P_n.$$

Channel coverage $P_n$ of a list $L_n$ of a channel $ch_p$ is understood to mean either the temporal coverage of the channel as sum of the time durations $t_{nxi}$ of all instances i of all candidate patterns $m_{nx}$ of the channel, in relation to the total duration $T_p$ of the channel $ch_p$; or the note-related coverage of the channel as sum of the numbers of notes $n_{nxi}$ in all instances i of all candidate patters $m_{nx}$ of the channel, in relation to the total number $N_p$ of notes of the channel $ch_p$; or preferably both the temporal and the note-related coverage in weighted form, e.g. equally weighted, i.e.

$$P_n = \frac{1}{2}\left(\frac{\sum_{x,i} t_{nxi}}{T_p} + \frac{\sum_{x,i} n_{nxi}}{N_p}\right)$$

In an optional step, after determination of the intrinsic similarity values $E_n$ of the lists $L_n$, e.g. directly after step b), for a specific channel $ch_p$ all those lists $L_n$ of the channel $ch_p$ having intrinsic similarity values $E_n$ that do not reach a preset threshold value can be deleted. The threshold value can preferably be predetermined adaptively or dynamically, e.g. as a percentage of the highest intrinsic similarity value $E_n$ of all lists $L_n$ of the channel $ch_p$, e.g. at least 70% or particularly preferred about 85% of the highest intrinsic similarity value $E_n$ of all lists $L_n$ of the channel $ch_p$.

c) Calculation of the Coincidence Values

Figure 18:
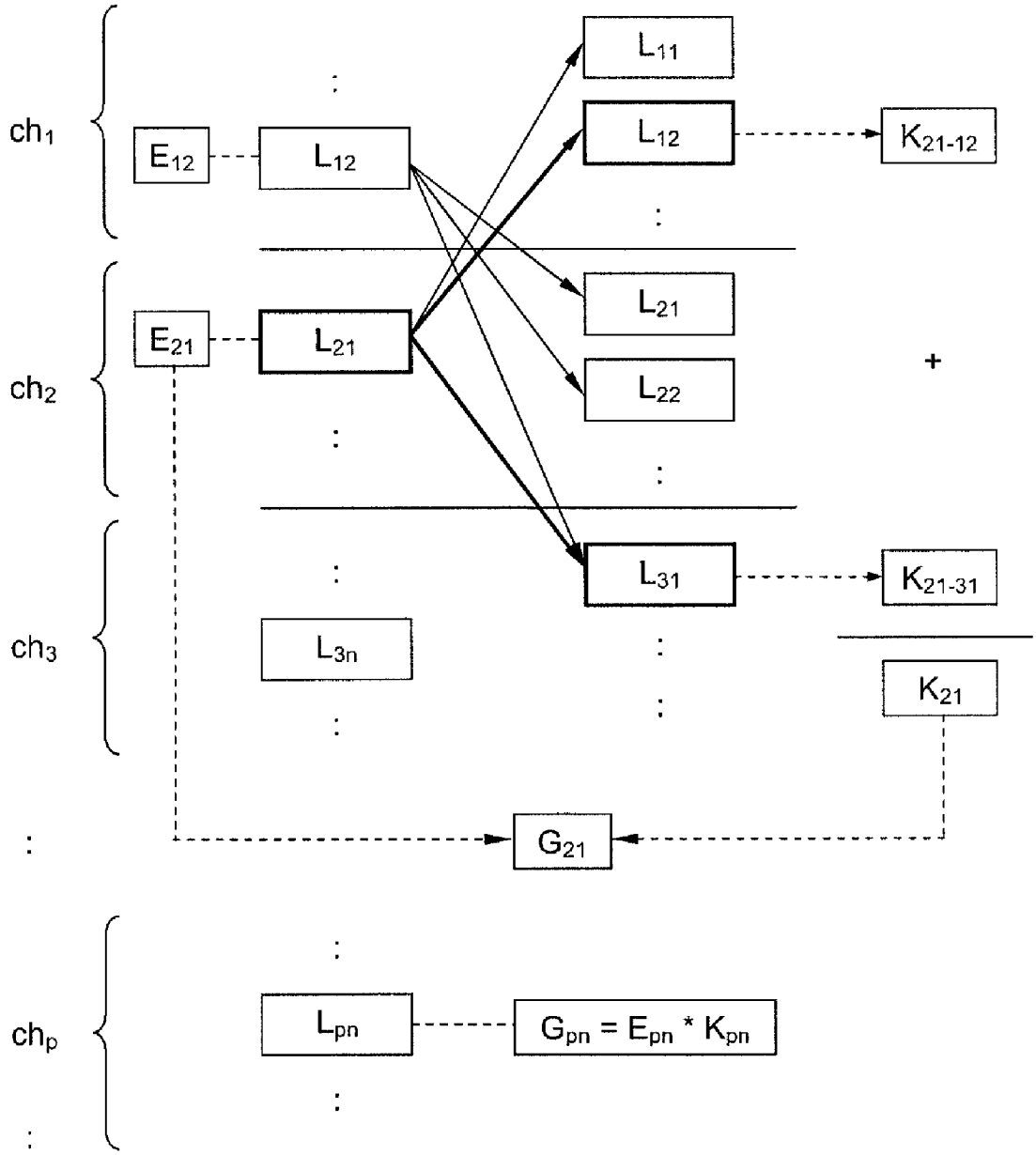
FIG. 18 shows the combination of the intrinsic similarity and coincidence values and the calculation of the total value of a list according to step d)

In step c) coincidence values are calculated for each list $L_n$, i.e. between each list $L_n$ of every channel $ch_p$ and each list $L_n$ of every other channel $ch_p$, as outlined in FIGS. 17 and 18.

FIG. 18 shows—as representative of all these coincidence value calculations—the first list $L_{21}$ of the channel $ch_2$, which is respectively compared with all other lists (but not with the lists of its own channel $ch_2$) in order to respectively calculate coincidence values $K_{21\text{-}12}$, $K_{21\text{-}31}$ etc., in general $K_{pn\text{-}p'n'}$ (with $p' \neq p$), from which a total coincidence value $K_{pn}$ is then determined for each list $L_{pn}$, as will be described further below.

According to FIG. 17 a coincidence value is calculated from the temporal overlaps u of the instances $i_i$ of two lists to be compared with one another—for simplicity only indicated as $L_1$ and $L_2$ in FIG. 17—: the coincidence value $K_{pn\text{-}'n'}$ is the sum of all time durations $t_i$ of all those instance overlaps u that are taken into consideration as below in relation to the time duration T of the entire channel $ch_p$ considered.

In this case only those overlaps u of instances $i_i$ of a candidate pattern $m_{1x}$ of list $L_1$ with instances $i_i$ of the candidate pattern $m_{2x}$ of list $L_2$ that occur at least twice are considered, and only those overlaps u that generate the longest—candidate pattern-related—overlap times $t_i$. In the example of FIG. 17 this means: the candidate pattern $m_{1b}$ (i.e. its three instances $i_1$, $i_2$, $i_3$) overlaps three times with instances of one and the same candidate pattern of the second list $L_2$, i.e. with three instances $i_1$, $i_2$ and $i_5$ of the candidate pattern $m_{2a}$ at overlap times $t_1$, $t_2$ and $t_5$; and only these overlap times are taken into consideration for the candidate pattern $m_{1b}$.

All further overlaps of the candidate pattern $m_{1b}$ with instances of other candidate patterns, e.g. instances $i_1$ and $i_4$ of $m_{2b}$, remain unconsidered, since these overlaps are shorter than the aforementioned. The repeated overlap of instance $i_2$ of $m_{1b}$ with instance $i_3$ of $m_{2a}$ is not counted, but respectively only one double overlap per instance of the first list $L_1$, i.e. the longest in time.

Repeated overlaps v of instances $i_1$ and $i_2$ of the candidate pattern $m_{1a}$ with instances $i_1$ and $i_2$ of the candidate pattern $m_{2b}$ likewise remain unconsidered, since the overlaps u of instances $i_3$ and $i_4$ of $m_{1a}$ with instances $i_1$ and of $m_{2a}$ were taken into consideration.

The coincidence value $K_{pn-p'n'}$ can optionally be increased for instances coinciding exactly in its beginning or end—in the shown example of FIG. 17 the coincident beginnings of the first instances $i_1$ of the candidate patterns $m_{1b}$ and $m_{2a}$ as well as the coincidences $i_1$ of the candidate patterns $m_{1b}$ and $m_{2a}$ as well as the coincidence of the ends of the third instances $i_3$ of $m_{1a}$ and $m_{2a}$ or the beginnings of the fourth instances $i_4$ of $m_{1a}$ and $m_{2a}$—for each coincidence in particular, e.g. incremented by a given "bonus value".

Coming back to the general method of reference in FIG. 18, there thus results for the list $L_{pn}$ of channel $ch_p$ the coincidence values $K_{pn-p'n'}$ in relation to the lists of all other channels:

$$K_{pn-p'n'} = \frac{\sum_i t_{pn,i}}{T_p} \text{ with } T_p = T_{p'}$$

d) Combination of the Intrinsic Similarity and Coincidence Values

The intrinsic similarity values $E_{pn}$ and coincidence values $K_{pn-p'n'}$ determined for each list $L_{pn}$ are combined to form a total value $G_{pn}$ of list $L_{pn}$, e.g. by addition, multiplication or other mathematical operations.

The following combination is applied: as illustrated in FIG. 18, for a list, e.g. the first list $L_{21}$ of the second channel $ch_2$, only those coincidence values $K_{21-p'n'}$ in relation to lists $L_{p'n'}$ of the other channels $ch_{p'}$, which respectively have the highest value there in each channel, are taken into consideration. In the shown example this relates to the coincidence value $K_{21-12}$ for the second list $L_{12}$ of the first channel $ch_1$ and the coincidence value $K_{21-31}$ to the first list $L_{31}$ of the third channel $ch_3$.

These channel-maximum coincidence values are added to a total coincidence value $K_{pn}$ for the list $L_{pn}$, i.e.:

$$K_{pn} = \sum_{p'} \max_{in\ p'}(K_{pn-p'n'}).$$

The total coincidence value $K_{pn}$ of the list $L_{pn}$ is then multiplied by the intrinsic similarity value $E_{pn}$ of the list $L_{pn}$ to give a total value $G_{pn}$ for the list $L_{pn}$:

$$G_{pn}=E_{pn}*K_{pn}$$

Then the respective list $L_p$ that has the highest total value $G_p$ is sought in each channel $ch_p$ $$G_p = \max_{in\ p}(G_{pn})$$

Figure 19:
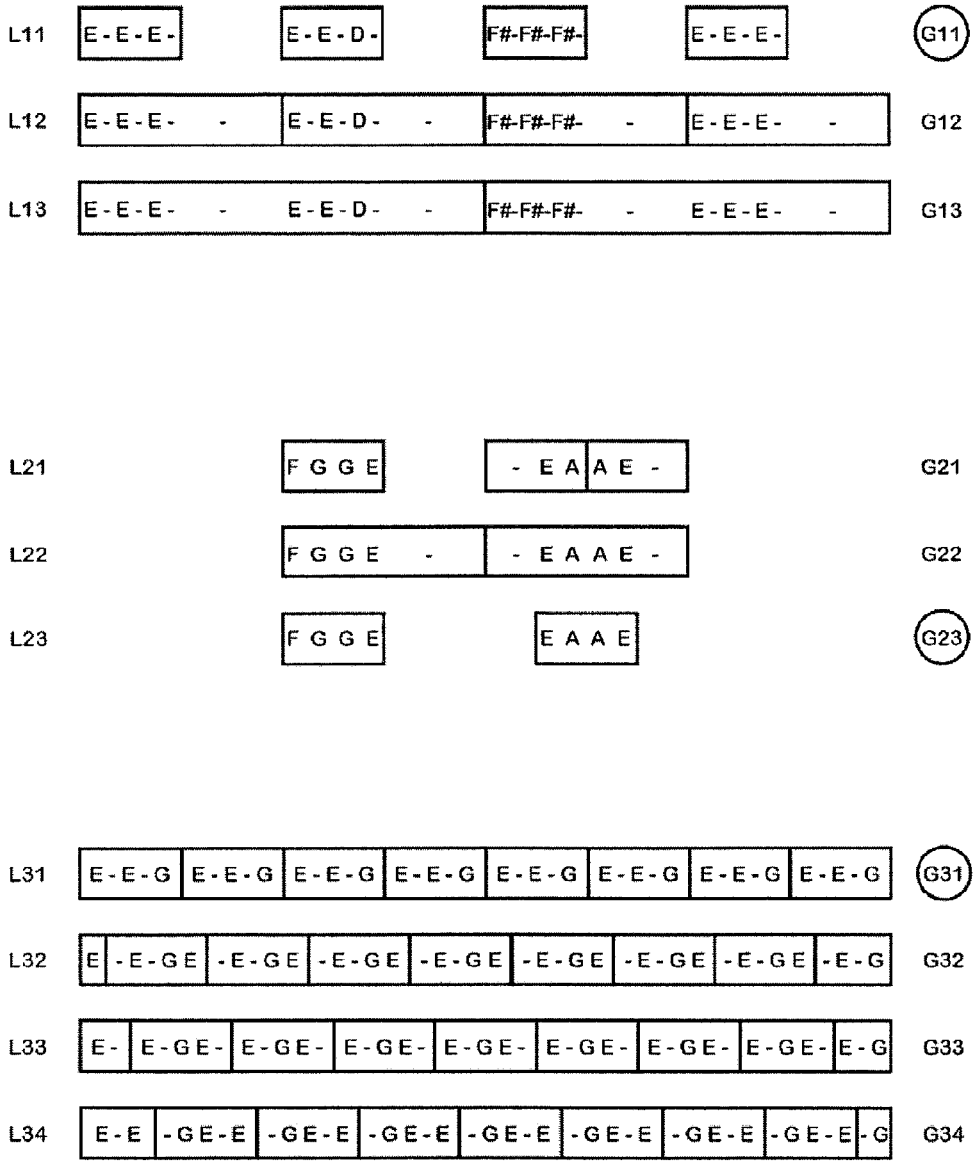
FIGS. 19 and 20 show the result of the application of the method to the input signal of FIGS. 1 and 2 in the form of the possible (FIG. 19) and the best (FIG. 20) channel coverages, the latter of which represent the note patterns recognized in the channels.

In the example shown in FIG. 19, which is based on the input sequences of FIGS. 1 and 2, these are list $L_{12}$ as result list $L_1$ of the first channel $ch_1$, list $L_{21}$ as result list $L_2$ of the second channel $ch_2$ and list $L_{33}$ as result list $L_3$ of the third channel $ch_t$.

Figure 20:
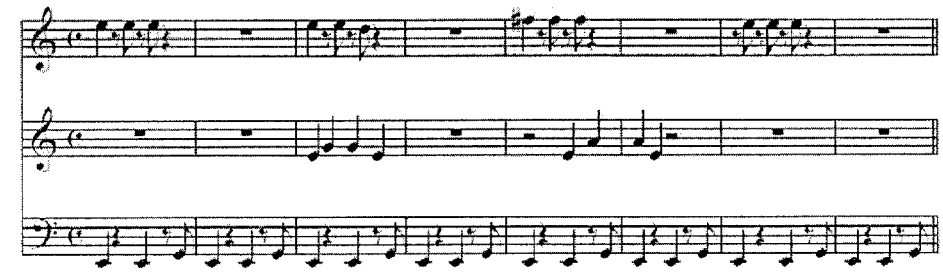

The candidate patterns $m_{px}$ of list $L_p$ thus constitute the respectively best known similarly recurring note patterns of the channel—i.e. with consideration of its structure relations to all other channels—as shown in FIG. 20.

The invention is not restricted to the represented embodiments, but covers all variants and modifications that fall within the framework of the attached claims.

What is claimed is:

1. Method for recognizing similarly recurring patterns of notes in a piece of music, which contains note sequences distributed on parallel channels comprising the steps of:

a) repeatedly segmenting each channel by varying segment length and segment beginning and, for each type of segmentation, determining segments that are similar to one another and storing these in lists of candidate patterns with their respective instances, i.e. one list respectively for each type of segmentation and channel;

b) calculating an intrinsic similarity value for each list, which is based on the similarities of the instances of each candidate pattern of a list with one another;

c) calculating coincidence values for each list for each channel with respect to the lists for all other channels, which is respectively based on the overlaps of instances of a candidate pattern of one list with instances of a candidate pattern of the other list when these overlap at least twice; and d) combining the intrinsic similarity and coincidence values for each list to form a total value for each list and using the pattern candidates in the lists with the highest total value in each channel as recognized note patterns in the channel.

2. Method according to claim 1, wherein in step a) the following step is additionally conducted: a1) detecting the patterns identically recurring in a channel, selecting therefrom the patterns best covering the channel and storing these in a further list of candidate patterns with their respective instances for each channel.

3. Method according to claim 2, wherein in step a1) the detection of identically recurring patterns is conducted by means of the correlation matrix method known per se.

4. Method according to claim 2, wherein in step a1) the selection of the best covering patterns is achieved by iterative selection of the respective most frequent and/or longest pattern from the detected patterns.

5. Method according to claim 1, wherein in step a) the segment length is varied in multiples of the rhythmic unit of the piece of music.

6. Method according to claim 5, wherein the segment length is varied from double the average note duration of the piece of music to half the length of the piece of music.

7. Method according to claim 1, wherein in step a) the determination of segments that are similar to one another is achieved by aligning the notes of two segments with one another, determining a degree of consistency of both segments and recognizing similarity when the degree of consistency exceeds a preset threshold value.

8. Method according to claim 7, wherein the alignment of the notes is achieved by means of the dynamic programming method known per se.

9. Method according to claim 1, wherein in step b) for each candidate pattern for the list a similarity matrix of its instances (i) is drawn up, the values of which are combined to form the intrinsic similarity value for the list, preferably with weighting by the channel coverage of the candidate patterns for the list.

10. Method according to claim 1, wherein at the end of step b) those lists for a channel whose intrinsic similarity value do not reach a preset threshold value are deleted.

11. Method according to claim 10, wherein the preset threshold value is a percentage of the highest intrinsic similarity value of all lists for the channel, preferably at least 70%, particularly preferred about 85%.

12. Method according to claim 1, wherein in step c) for a specific candidate pattern of a list only the overlaps with those instances of the other list, with which the longest overlaps in time are present, are taken into consideration.

13. Method according to claim 1, wherein in combining step d) for each list for each channel only those coincidence values to the lists of the other channels that represent the respectively highest value are taken into consideration.

14. Method according to claim 1, wherein in combining step d) the coincidence values taken into consideration for a list are respectively added up.

15. Method according to claim 14, wherein in combining step d) the added coincidence values are multiplied by the intrinsic similarity value for the list to form the said total value.

* * * * *

UNITED STATES PATENT AND TRADEMARK OFFICE

CERTIFICATE OF CORRECTION

PATENT NO. : 8,283,548 B2
APPLICATION NO. : 13/125200
DATED : October 9, 2012
INVENTOR(S) : Oertl et al.

It is certified that error appears in the above-identified patent and that said Letters Patent is hereby corrected as shown below:

Column 3, line 51:

Now reads: "is provided that when combining step e) for..."

Should read: -- is provided that when combining step d) for... --

Column 3, line 57:

Now reads: "combining step e) for coincidence values..."

Should read: -- combining step d) for coincidence values... --

Column 10, line 12:

Now reads: "channel $ch_1$."

Should read: -- channel $ch_3$. --

Column 11, line 8:

Now reads: "instances (i) is drawn up, the values..."

Should read: -- instances is drawn up, the values... --

Signed and Sealed this
Fifteenth Day of January, 2013

David J. Kappos

David J. Kappos
*Director of the United States Patent and Trademark Office*